US006834813B1

(12) United States Patent
Nobi

(10) Patent No.: US 6,834,813 B1
(45) Date of Patent: Dec. 28, 2004

(54) IN-BUILDING WALL-MOUNTED WATER-PROVIDING ASSEMBLY

(76) Inventor: Jeremy E. Nobi, 4158 Foothills Dr., Loveland, CO (US) 80537

( * ) Notice: Subject to any disclaimer, the term of this patent is extended or adjusted under 35 U.S.C. 154(b) by 141 days.

(21) Appl. No.: 10/314,688

(22) Filed: Dec. 11, 2002

(51) Int. Cl.[7] ..... B65H 75/00

(52) U.S. Cl. ..... 239/197; 239/195; 239/282; 239/525; 137/355.16; 137/355.23; 137/355.26

(58) Field of Search ..... 239/195, 197, 239/198, 273, 282, 283, 525, 530, 532; 169/51; 137/355.12, 355.16, 355.2, 355.21, 355.22, 355.23, 355.26, 396, 396.1, 396.4; 242/398

(56) References Cited

U.S. PATENT DOCUMENTS

| | | | | | |
|---|---|---|---|---|---|
| 2,010,811 | A | | 8/1935 | Craig | |
| 3,437,105 | A | * | 4/1969 | Stracek | 137/355.23 |
| 3,776,262 | A | * | 12/1973 | Fritsch | 137/355.16 |
| 4,062,493 | A | | 12/1977 | Suggs | |
| 4,537,215 | A | | 8/1985 | Roman | |
| 4,543,982 | A | | 10/1985 | Wolfe | |
| D289,492 | S | | 4/1987 | Clivio et al. | |
| 5,526,842 | A | * | 6/1996 | Christensen | 137/355.23 |
| 5,568,824 | A | * | 10/1996 | Cordrey | 137/355.16 |
| 5,678,596 | A | * | 10/1997 | Corallo | 137/355.16 |
| 5,782,412 | A | | 7/1998 | Plantz et al. | |
| 6,691,930 | B2 | * | 2/2004 | Lu | 239/197 |

* cited by examiner

*Primary Examiner*—Steven J. Ganey

(57) ABSTRACT

An in-building wall-mounted water-providing assembly for providing a means to have water readily and easily accessible indoors for watering plants and such. The in-building wall-mounted water-providing assembly includes a reel support assembly including a bracket being adapted to fasten to a wall of a building, and also including a reel support member being attached to the bracket, and further including a shaft being journaled to the bracket; and also includes a reel member being rotatably mounted upon the reel support member; and further includes a water conduit assembly including a hose being carried about the reel member; and also includes a hose windup/brake assembly including a coiled spring being attached to the shaft and to the reel member for winding up the hose about the reel member.

8 Claims, 4 Drawing Sheets

IN-BUILDING WALL-MOUNTED WATER-PROVIDING ASSEMBLY

BACKGROUND OF THE INVENTION

1. Field of the Invention

The present invention relates to in-house-mounted watering systems and more particularly pertains to a new in-building wall-mounted water-providing assembly for providing a means to have water readily and easily accessible indoors for watering plants and such.

2. Description of the Prior Art

The use of in-house-mounted watering systems is known in the prior art. More specifically, in-house-mounted watering systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Patent Nos. 5,782,412; 2,010,811; 4,537,215; 4,543,982; 4,062,493; and Des. 289, 492.

While these devices fulfill their respective, particular objectives and requirements, the aforementioned patents do not disclose a new in-building wall-mounted water-providing assembly. The prior art includes reels, springs, brackets, and hoses which are wound up about the reels.

SUMMARY OF THE INVENTION

The general purpose of the present invention, which will be described subsequently in greater detail, is to provide a new in-building wall-mounted water-providing assembly which has many of the advantages of the in-house-mounted watering systems mentioned heretofore and many novel features that result in a new in-building wall-mounted water-providing assembly which is not anticipated, rendered obvious, suggested, or even implied by any of the prior art in-house-mounted watering systems, either alone or in any combination thereof. The present invention includes a reel support assembly including a bracket being adapted to fasten to a wall of a building, and also including a reel support member being attached to the bracket, and further including a shaft being journaled to the bracket; and also includes a reel member being rotatably mounted upon the reel support member; and further includes a water conduit assembly including a hose being carried about the reel member; and also includes a hose windup/brake assembly including a coiled spring being attached to the shaft and to the reel member for winding up the hose about the reel member. None of the prior art includes the combination of the elements of the present invention.

There has thus been outlined, rather broadly, the more important features of the in-building wall-mounted water-providing assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new in-building wall-mounted water-providing assembly which has many of the advantages of the in-house-mounted watering systems mentioned heretofore and many novel features that result in a new in-building wall-mounted water-providing assembly which is not anticipated, rendered obvious, suggested, or even implied by any of the prior art in-house-mounted watering systems, either alone or in any combination thereof.

Still another object of the present invention is to provide a new in-building wall-mounted water-providing assembly for providing a means to have water readily and easily accessible indoors for watering plants and such.

Still yet another object of the present invention is to provide a new in-building wall-mounted water-providing assembly that is easy and convenient to set up and use.

Even still another object of the present invention is to provide a new in-building wall-mounted water-providing assembly that can be installed under a kitchen sink and can be easily and quickly attached to the pipelines under the kitchen sink.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
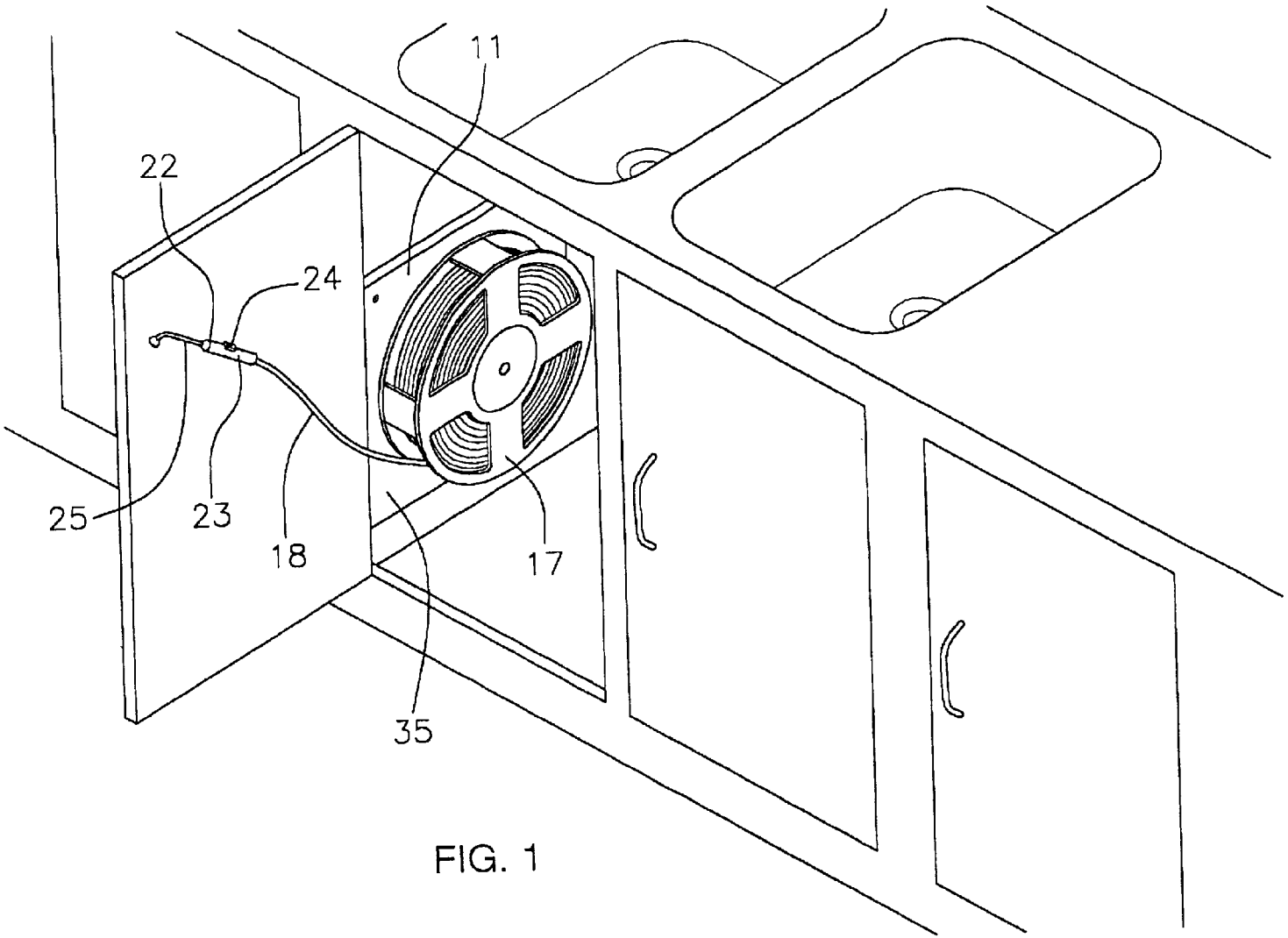
FIG. 1 is a perspective view of a new in-building wall-mounted water-providing assembly according to the present invention and shown in use.
Figure 2:
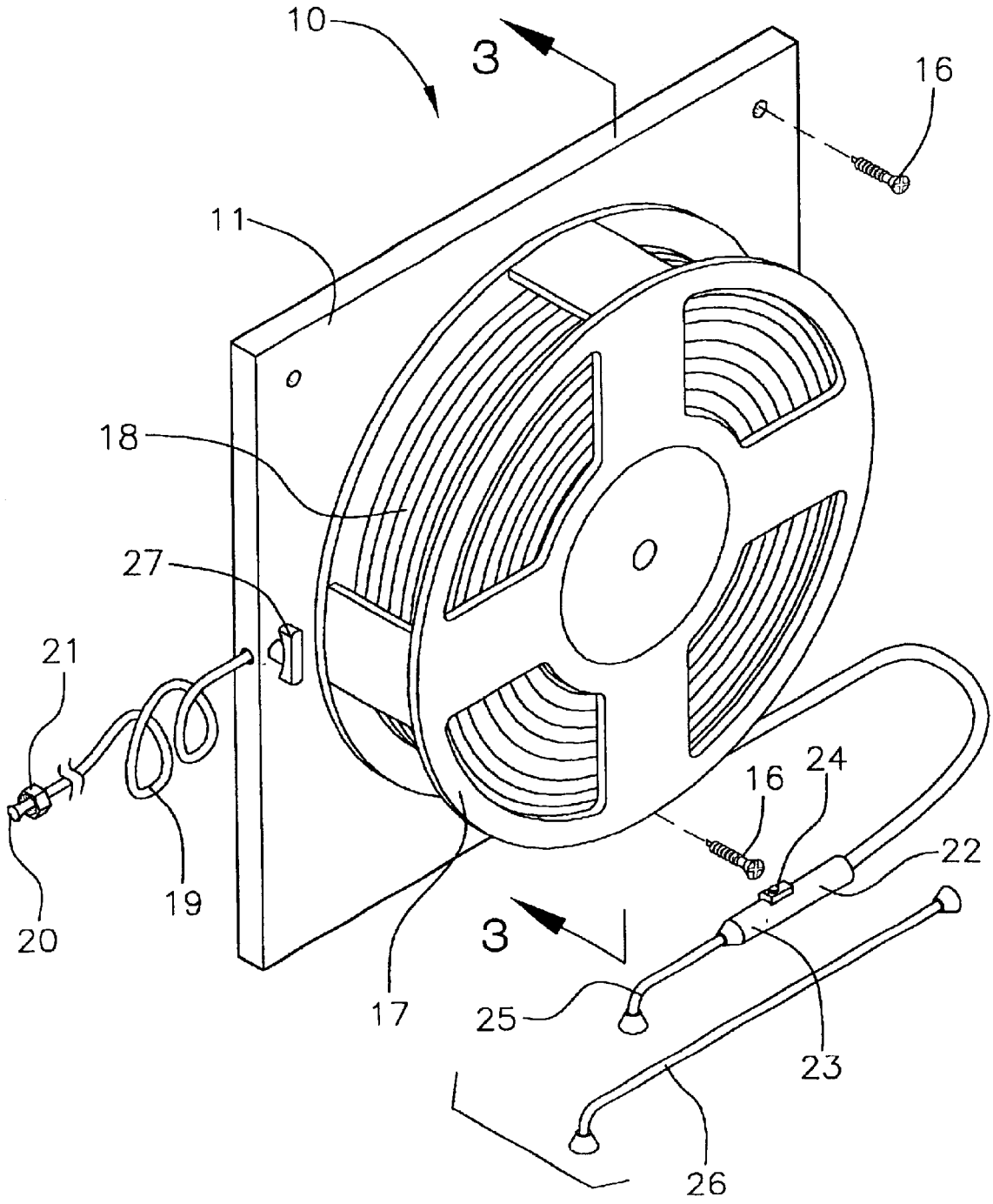
FIG. 2 is another perspective view of the present invention.
Figure 3:
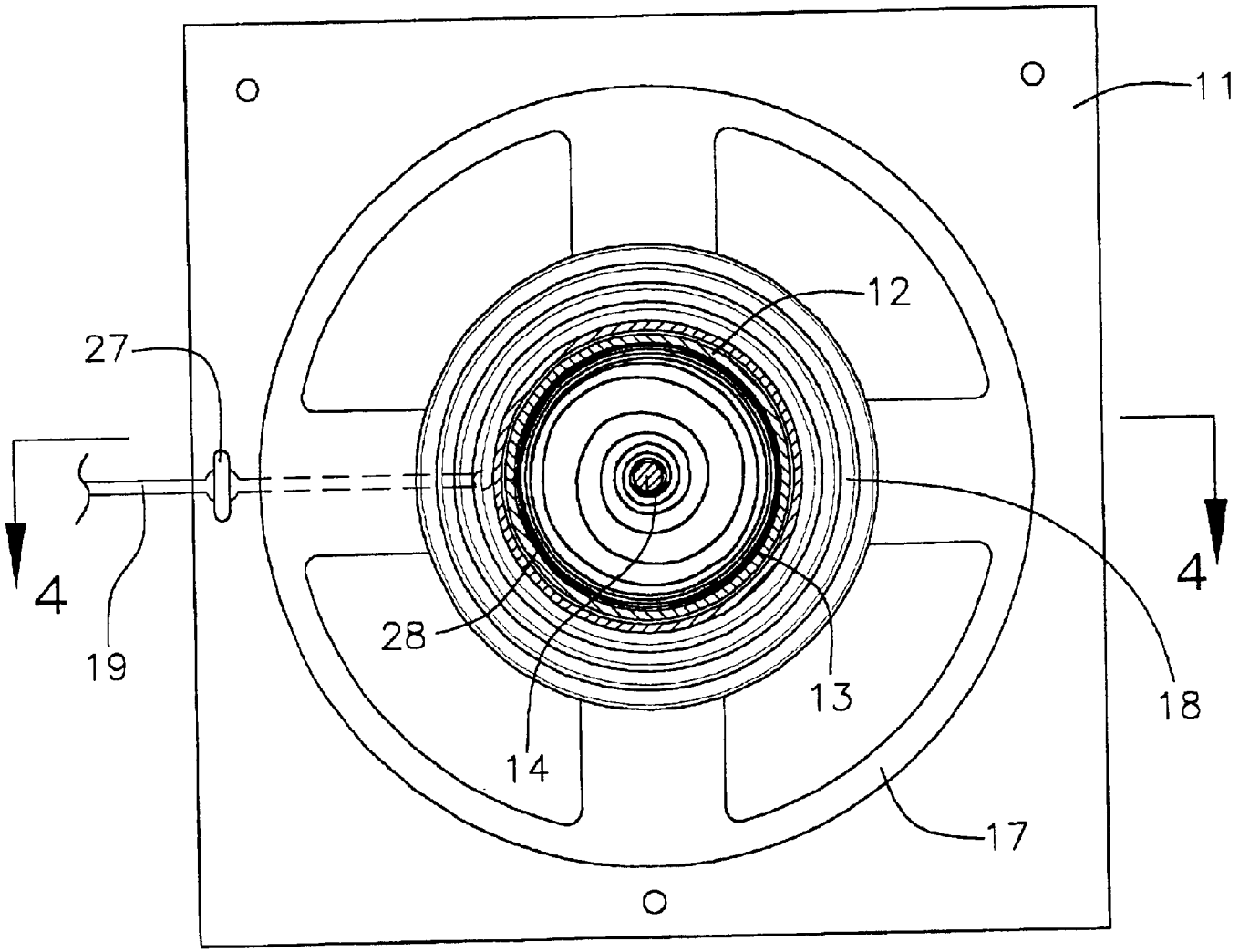
FIG. 3 is a side elevational view of the present invention.
Figure 4:
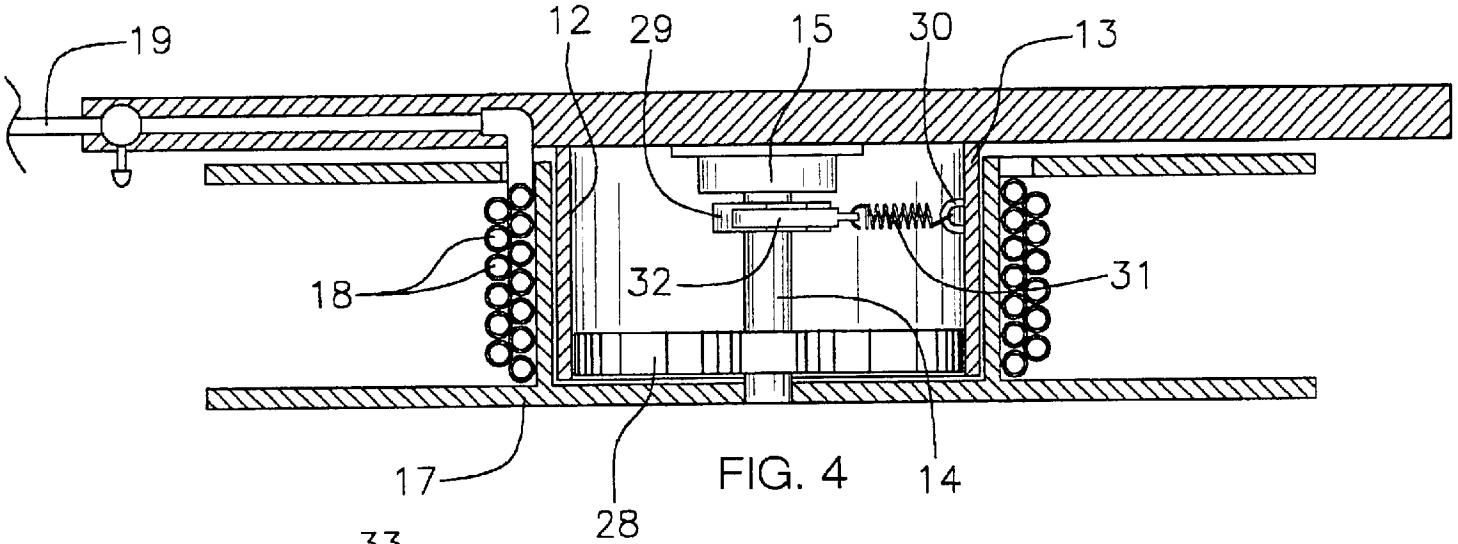
FIG. 4 is a lateral cross-sectional view of the present invention.
Figure 5:
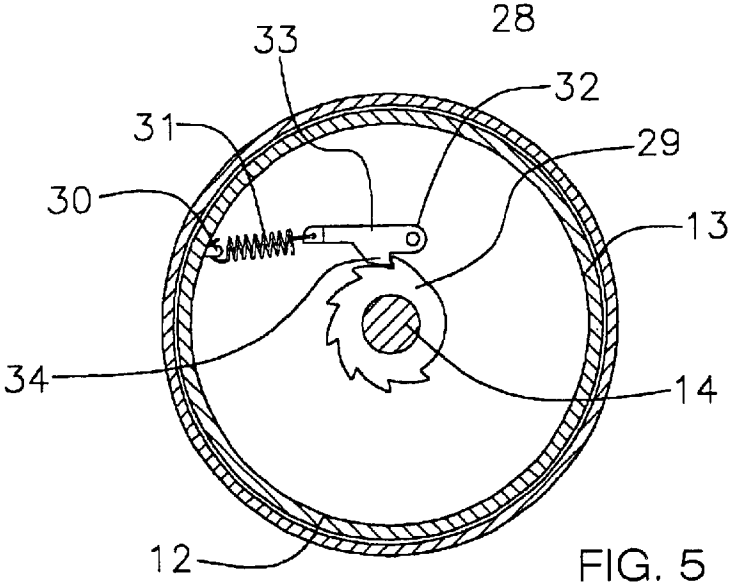
FIG. 5 is a longitudinal cross-sectional view of the present invention.

With reference now to the drawings, and in particular to FIGS. 1 through 5 thereof, a new in-building wall-mounted water-providing assembly embodying the principles and concepts of the present invention and generally designated by the reference numeral 10 will be described.

As best illustrated in FIGS. 1 through 5, the in-building wall-mounted water-providing assembly 10 generally comprises a reel support assembly including a bracket 11 being adapted to fasten to a wall 35 of a building, and also including a reel support member 12 being conventionally attached to the bracket 11, and further including a shaft 14 being journaled to the bracket 11. The bracket 11 is a board member having holes being disposed near a perimeter thereof and being adapted to receive fasteners 16 for fastening the board member 11 to the wall 35. The reel support assembly also includes a bearing member 15 being conventionally attached to a side of the board member 11 with an end portion of the shaft 14 being journaled in the bearing member 15 with the shaft 14 extending generally perpendicular to the board member 11. The reel support member 12 is a hollow cylindrical member with the shaft 14 being rotatably disposed in the hollow cylindrical member 12. A reel member 17 is rotatably and conventionally mounted about the reel support member 12.

A water conduit assembly includes a hose 18 being carried about the reel member 17. The water conduit, assembly also includes a conduit member 19 being adapted to be fastenable to a water supply and being conventionally attached to the hose 18 and having an end 20, and further includes a fastening member 21 being conventionally connected at the end 20 of the conduit member 19 and being adapted to fasten to the water supply, and also includes a valve member 22 being conventionally attached to an end of the hose 18, and further includes a nozzle 25 being conventionally and detachably attached to the valve member 22. The water conduit assembly also includes a shutoff valve 27 having a handle portion that is conventionally mounted to the board member 11 and also having a valve portion being conventionally disposed inline of the conduit member 19. The water conduit assembly further includes a tubular extension member 26 being conventionally attachable to the valve member 22 and having an elongate main portion and an angled end portion with a connector being conventionally attached at one end thereof. The valve member 22 includes a valve body 23 and also a trigger member 24 being movably and conventionally attached to the valve body 23 to control flow of water through the valve body 23.

A hose windup/brake assembly includes a coiled spring 28 being conventionally attached to the shaft 14 and to the reel member 17 for winding up the hose 18 about the reel member 17. The hose windup/brake assembly also includes ratchet wheel 29 being conventionally mounted about the shaft 14 for rotation therewith, and further includes an eyelet 30 being conventionally attached to inner side of a wall 13 of the hollow cylindrical member 12, and also includes a spring member 31 being conventionally connected to the eyelet 30, and further includes a catch 32 being conventionally connected to the spring member 31 and being removably engaged to the ratchet wheel 29. The catch 32 has a lever portion 33 and a flange portion 34 extending from the lever portion 33 and biasedly engaged to the ratchet wheel 29.

In use, the user lets out the hose 18 from the reel member 17 by simply pulling on the hose 18. The catch 32 and the ratchet wheel 29 prevent the backup and take up of the hose about the reel member 17. The user opens the shutoff valve 27 to allow water to flow through the conduit member 19 and through the hose 18, and the user controls the amount of water flowing out of the hose 18 by manipulating the trigger 24 of the valve member 22. When finished, the catch 32 is disengaged from the ratchet wheel 29 with the coiled spring 28 rotating the reel member 17 to take up the hose 18 thereabout.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the in-building wall-mounted water-providing assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An in-building wall-mounted water-providing assembly comprising:

a reel support assembly including a bracket being adapted to fasten to a wall of a building, and also including a reel support member being attached to said bracket, and further including a shaft being journaled to said bracket, said bracket being a board member having holes being disposed near a perimeter thereof and being adapted to receive fasteners for fastening said board member to the wall, said reel support assembly also including a bearing member being attached to a side of said board member with an end portion of said shaft being journaled in said bearing member, said shaft extending generally perpendicular to said board member;

a reel member being rotatable mounted upon said reel support member;

a water conduit assembly including a hose being carried about said reel member; and a hose windup/brake assembly including a coiled spring being attached to said shaft and to said reel member for winding up said hose about said reel member.

2. An in-building wall-mounted water-providing assembly as described in claim 1, wherein said reel support member is a hollow cylindrical member with said shaft being rotatably disposed in said hollow cylindrical member.

3. An in-building wall-mounted water-providing assembly as described in claim 2, wherein said water conduit assembly also includes a conduit member being adapted to be fastenable to a water supply and being attached to said hose and having an end, and further includes a fastening member being connected at said end of said conduit member and being adapted to fasten to the water supply, and also includes a valve member being attached to an end of said hose, and further includes a nozzle being detachably attached to said valve member.

4. An in-building wall-mounted water-providing assembly as described in claim 3, wherein said water conduit assembly also includes a shutoff valve having a handle portion which is mounted to said board member and also having a valve portion being disposed inline of said conduit member.

5. An in-building wall-mounted water-providing assembly as described in claim 4, wherein said water conduit assembly further includes a tubular extension member being attachable to said valve member and having an elongate main portion and an angled end portion with a connector being attached at one end thereof.

6. An in-building wall-mounted water-providing assembly as described in claim 4, wherein said valve member includes a valve body and also a trigger member being movably attached to said valve body to control flow of water through said valve body.

7. An in-building wall-mounted water-providing assembly as described in claim 2, wherein said hose windup/brake assembly also includes ratchet wheel being mounted about said shaft for rotation therewith, and further includes an eyelet being attached to inner side of a wall of said hollow cylindrical member, and also includes a spring member being connected to said eyelet, and further includes a catch being connected to said spring member and being removably engaged to said ratchet wheel.

8. An in-building wall-mounted water-providing assembly as described in claim 7, wherein said catch has a lever portion and a flange portion extending from said lever portion and biasedly engaged to said ratchet wheel.

* * * * *